US006006383A

United States Patent [19]

Pile et al.

[11] Patent Number: 6,006,383

[45] Date of Patent: Dec. 28, 1999

[54] MATTRESS COVER

[75] Inventors: Brian Frank Pile, Fareham; Peter John Eames, Portsmouth, both of United Kingdom

[73] Assignee: Pegasus Egerton Limited, United Kingdom

[21] Appl. No.: 08/925,044

[22] Filed: Sep. 8, 1997

[30] Foreign Application Priority Data

Sep. 9, 1996 [GB] United Kingdom ..... 9618796

[51] Int. Cl.[6] ..... A47C 27/08; A47G 9/00

[52] U.S. Cl. ..... 5/706; 5/737; 5/738; 5/482; 5/496

[58] Field of Search ..... 5/706, 710, 713, 5/731, 737, 738, 482, 495, 496, 497, 499, 900.5

[56] References Cited

U.S. PATENT DOCUMENTS

| | | | |
|---|---|---|---|
| 1,208,006 | 12/1916 | Rembiszewski et al. | 5/706 X |
| 2,253,801 | 8/1941 | Neal | 5/738 X |
| 2,326,441 | 8/1943 | Cunningham | 5/737 |
| 2,823,394 | 2/1958 | Smith | 5/738 X |
| 3,858,256 | 1/1975 | Beer | 5/496 |
| 3,906,559 | 9/1975 | Bahr | 5/496 |
| 3,959,835 | 6/1976 | Nos | 5/738 X |
| 4,706,313 | 11/1987 | Murphy | 5/738 X |
| 5,101,527 | 4/1992 | Wadsworth, III et al. | 5/737 X |
| 5,228,156 | 7/1993 | Wang | 5/706 X |
| 5,263,211 | 11/1993 | Grant . | |
| 5,267,364 | 12/1993 | Volk . | |
| 5,421,044 | 6/1995 | Steensen | 5/713 X |
| 5,729,853 | 3/1998 | Thompson | 5/713 |
| 5,755,000 | 5/1998 | Thompson | 5/713 |
| 5,881,410 | 3/1999 | Yamada | 5/713 |

FOREIGN PATENT DOCUMENTS

| | | | |
|---|---|---|---|
| 2083865 | 12/1971 | France . | |
| 0159299 | 2/1921 | United Kingdom | 5/710 |
| 1286197 | 8/1972 | United Kingdom . | |
| 1595417 | 8/1981 | United Kingdom . | |
| 95/31920 | 11/1995 | WIPO . | |

*Primary Examiner*—Michael F. Trettel
*Assistant Examiner*—Robert G. Santos
*Attorney, Agent, or Firm*—Larson & Taylor

[57] ABSTRACT

A mattress cover, for use on an air inflatable mattress which reduces the risk of bed sores in long term patients. The cover has a top sheet and side sheets attached to opposite edges of the top sheet. The length of the top sheet, in a laid-flat state, is greater than the length of the side sheets attached to the top sheet. This allows the cover to closely follow the undulating nature of the inflatable cells of the mattress, and zero pressure may be achieved. The cover may also comprise end sheets, an outer skirt, and a base portion. The present invention also provides a method of making cover, which comprises the step of stretching the side portions, while the top sheet is in a substantially unstretched condition, and then joining the side sheets in their stretched condition to the top sheet.

16 Claims, 3 Drawing Sheets

MATTRESS COVER

BACKGROUND OF THE INVENTION

1. Field of the Invention

The present invention relates to a cover for a support, more particularly to a cover for an inflatable support such as a mattress or cushion for a human or animal body. The invention also relates to methods of making such a cover, and to inflatable supports, such as mattresses, having a plurality of inflatable supports and the cover.

2. Description of the Prior Art

The use of pressure-cycling air inflatable mattresses is well known for the reduction of bed sores, and is described, for example, in GB-A-1 595 417. The present applicants sell a range of these mattresses for this purpose, for example, the Airwave Plus™, in which a controller sequentially inflates and deflates a plurality of overlapping groups of air tubes extending transversely to the length of the mattress. In this manner, each air cell cyclically provides support of, and relief from pressure to, a patient's body.

The majority of such inflatable mattress systems use a cover to prevent the mattress becoming contaminated or damaged by body fluids, wound exudate or other spillages. A cover for a mattress of this type must allow for the inflation and deflation of the air cells. Thus, a traditional mattress sheet as used on a conventional mattress will not suffice. Covers for inflatable mattresses are presently box-like in shape, having a top sheet and side sheets. The design relies on there being sufficient material elasticity and looseness in the top sheet to allow full inflation of the cells during the appropriate part of the inflation—deflation cycle. However, this type of cover on an inflatable mattress may prevent the achievement of zero interface pressure between the patient and the mattress. During the inflation and deflation cycle, one group of cells is necessarily in the deflated state. This deflation stage should allow a period of zero pressure on the patient's body, thus helping to reduce bed sores. However, the material of a cover as described above does not conform closely to the shape of the air cells and may form a hammock shape between inflated and deflated cells, or between two adjacent inflated cells. As a result, a state of zero pressure is not achieved where the cells are deflated. Thus, an inflatable mattress using a cover of this type is suitable only for patients at medium or high risk of developing bed sores, but is not suitable for those at very high risk. As a result, the use of the active mattress system is limited by the design of the cover.

As an alternative, a sheet might be used to cover the mattress, which closely follows the undulating shape of the inflating and deflating cells. However, the sheet does not remain accurately located in relation to the mattress, and further results in untidy skirts around the sides of the mattress which are difficult to keep clean.

It is thus an aim of the present invention to overcome and ameliorate the above problems of the prior art.

Accordingly, in a first aspect the present invention provides a cover for a support having a plurality of inflatable cells, said cover comprising a top sheet and at least opposite side sheets to which the top sheet is attached at opposite edges along an attachment length, wherein the length of the top sheet attached to the side sheets at said attachment length is, in its laid-flat state, greater than the length of said side sheet attached to the top sheet at said attachment length.

By this arrangement, the present invention provides a cover having a top sheet which has a full ness or non-tightness even when the side sheets are taut, as when mounted on a mattress. The top sheet therefore can conform closely to the undulating top surface of the air cells and yet is positively located in relation to the support, whilst the side sheets can lie flat and tidily against the sides of the support.

Preferably the top sheet and the side sheets are attached substantially continuously e.g. by stitching, along the whole of said attachment length, but attachment may be somewhat intermittent. Preferably the length of the top sheet, when laid flat is at least 50%, more preferably at least 10% greater than that of the side sheets. These lengths are measured in the unstitched condition.

The length of the top sheet attachment length to the side sheets may be the length parallel to any edge of the top sheet, and preferably is the length extending in the direction perpendicular to the longitudinal direction of the tubular air cells of the support being covered. The length of the side sheet attached to the top sheet may be the length parallel to any edge of the side sheet, and preferably is the length extending in the direction perpendicular to the longitudinal direction of the tubular air cells of the support being covered.

Preferably, the increase in length of the top sheet attached to the side sheet at the attachment length is, in its laid flat state, approximately equal to the difference in length of the upper surface of the mattress between a hypothetical situation where all cells are in the deflated state and the maximally inflated state of the air cells at any one point during a cycle.

Preferably the cover also comprises end sheets, joined to the top sheets and side sheets to form an open box-like structure, such that for example, each end sheet is substantially perpendicular to the side sheets, and to the top sheet, when the cover is fitted to the support.

The cover may also comprise an outer skirt, which lies external and parallel to the side sheets, extending around at least a portion of the circumference, and preferably the entire circumference of the support. The outer skirt preferably covers any joint (such as a zip fastener described below) between a base portion and the side sheets, thus reducing risk of entry of fluids through the joint.

Preferably, the cover also comprises a base portion, which may be a flat sheet or more preferably an open box-like structure. The base portion may be releasably attached, e.g. by a zip fastener, to the side sheets attached to the top sheet, such that the individual components may be separately cleaned and replaced.

An internal strap system may also be provided within the cover, in order to secure the cover to the support. Preferably, the system consists of one or more straps attached by at least one end to the cover and comprising means for attachment to the support. Such means may be a hook. One or more such internal straps may be attached to external straps, which are used to secure the support and cover to an external member, such as a bed frame or chair. Preferably, the internal and external straps are joined to each other through the cover or are joined only to the cover, thereby ensuring that piercing of the cover is kept to a minimum to reduce possible ingress of liquids. Thus, stress caused by fixing a support to an external member is transferred through the internal and external strap system to the support itself, allowing the cover to remain substantially free of stress. The internal and external strap system may be adapted in accordance with user specific requirements.

At least one handle, and preferably a pair, may be provided on the external surface of the cover, in order to facilitate moving of the mattress. The handles may be located at any position on the cover, but preferably are on opposing side sheets or end sheets of the cover.

The handles may be integral with or attached to internal straps located within the cover. These internal straps may be the same or different from the straps of the internal strap system. They may be located at any position within the cover, corresponding to the position of the handles on the outer surface. Where the internal straps are attached also to the support, this system allows the support and cover to be moved while minimizing strain on the cover itself.

The support can be a device such as an air inflatable mattress for the prevention of bed sores, or a cushion for a wheel chair for a similar purpose, or a calf support attachable to a wheel chair, having a plurality of groups of inflatable air cells which inflate and deflate sequentially and extend in a transverse fashion across the surface of the support. There may be two or more layers of tubes as shown in GBA-1595417. Each group of cells has at least one cell, preferably two or more, depending on the size of the support.

The inflatable cells of the support may be of any shape, but it is preferable that they are tubular in shape and lie transverse to a longitudinal direction of the support.

In a second aspect of the present invention there is provided a method of making a cover for a support having a plurality of inflatable cells, said cover comprising a top sheet and side sheets to which the top sheet is attached along opposing edges, wherein the method comprises the following steps:

(i) stretching said side sheets along their length, and (ii) joining the side sheets in their stretched condition to the top sheet when the top sheet is unstretched or is stretched to a lesser extent than the side sheets, so that when the side sheets are relaxed, they cause the top sheet to assume a length which is less than its laid flat length.

The side sheets may be stretched along whole or part of their length, or sequentially along different parts of their length.

The length of the top sheet attachment length to the side sheets, and the length of the side sheets, may be as described above.

The increase in length of the top sheet attached to the side sheet at the attachment length may also be as described above. A small amount of stretching of the top sheet during this process may prevent puckering of the material during joining.

The process described above may be performed on parallel edges of the top sheet, preferably said edges extending in the direction of the attachment length as described above. In order to prevent puckering or "creep" of the material, it is preferable that the joining is carried out in the same direction along the parallel edges of the top sheet.

Joining the side sheets to the top sheets may be done in one or more steps. Preferably, the side sheets are first attached to the top sheet at one or more points spaced apart along the attachment length. Preferably, the side sheets are first attached to the top sheet at the ends of the attachment length. Such attachment prior to the joining process allows accurate alignment of the top sheet and side sheet in relation to one another, such that the top sheet displays no twist or misalignment across the inflatable cells of a support, when placed on a support. The side sheets and top sheets are then stretched and joined together between said points. The side sheet and the top sheet may then be relaxed from their stretched condition.

It is preferable also that an outer skirt sheet is provided, external to and parallel to the side sheets. Preferably the outer skirt extends around the entire circumference of the cover. If an outer skirt is used, the outer skirt and side sheets may be joined to the top sheet simultaneously, according to the method described above. This prevents the need for additional joints in the cover.

The side sheets and outer skirts may be joined to the top sheet by any conventional joining method, such as gluing, heat sealing or stitching. Preferably, stitching is used. The stitching may be of any suitable type, but may be a machine stitch, e.g. of approximately 12 stitches per inch. Such a pitch allows a tight join between the materials, preventing puckering and gathering, and still allowing said materials to return to their unstretched condition.

Prior to stretching and joining the side sheets and end sheets to the top sheet, one half of a zip fastener may be joined to the side sheets and end sheets. One edge of the outer skirt may be tape sealed, prior to joining to the top sheet.

Alternatively, the zip fastener portion and tape sealing may be added to the side sheets and outer skirt after stretching and joining to the top sheet.

End sheets may also be joined to the top sheet, such that when the cover is fitted to a support each end sheet is approximately perpendicular to the side sheet and to the top sheet. The end sheets may be joined prior to, or after, joining and relaxing of the side sheets and the outer skirt. The side sheets and outer skirts may then be everted together with the end sheets to form a box-like structure.

After relaxation of all components to their unstretched condition, one or more outer joints may be added to the outer surface of the cover, joining all components of the cover, in order to hold the components together more securely. Preferably, a single outer joint is made around the entire circumference of the cover. The outer joint may use any conventional technique, such as stapling, rivetting or stitching. Preferably, stitching is used. It is also desirable that the outer joint is tape sealed in order to make the outer joint water tight.

A base portion may be attached to the side and end sheets, such that the cover extends over the entire surface of the support. The base portion may be a single sheet or more preferably an open box-like structure.

One or more internal straps may be fixed within the cover, in order to secure the support within the cover. Each strap may be fixed at one end to an inner surface of the cover, using conventional techniques such as rivetting, gluing or stitching. Preferably, stitching is used. The internal straps may be attached to their external components by joining the internal strap, base cover and external strap, preferably by stitching. Alternatively, the external strap may be joined only to the base cover. The external straps may have attachment means fitted to a free end, said attachment means being securable to a support.

One or more handles may also be formed on the external surface of the cover, preferably on opposing side or end sheets. The handles may become integral with, or attached to internal straps. This may be done by joining the handles and internal straps and the cover, by any suitable method such as glueing or stitching.

In both aspects of the present invention, the top sheet, side sheets, end sheets, outer skirt and base portion may all be of dimensions to fit a desired support. Preferably, the top sheets, side sheets, end sheets and outer skirt are all elongate pieces of stretchable material.

Preferably, the length of the top sheet along its attachment length in its laid flat state is greater than the length of the support, and a width between the attachment to the side sheets substantially equal to the width of the support.

The side sheets in their unstretched condition may be substantially equal in length to the length of the support and shorter than the length of the top sheet, with a maximum width substantially equal to the depth of the support. Preferably, the width is less than the depth of the support, and more preferably substantially equal to half the depth of the support.

The end sheets may be substantially equal in length to the length of the ends of the support, and a maximum width substantially equal to the depth of the support. The width may be less than the depth of the support, and preferably is approximately equal to half the depth of the support.

The side sheets and end sheets may be formed from a single sheet of material, having a length substantially equal to the circumference of the support and a maximum width substantially equal to the depth of the support, and preferably approximately equal to half the depth of the support.

The outer skirt may be formed from one or more pieces of material, preferably a single piece of stretchable material of a length substantially equal to the circumference of the support, and a width sufficient to cover any joint between the side sheets and base portion extending around the circumference of the support. Preferably, the width is substantially equal to the depth of the support.

The base portion may be formed form a single sheet, or may be box like in shape, having dimensions to closely fit the lower part of a support.

The cover of the present invention may be made from any suitable material, which is preferably stretchable and waterproof.

BRIEF INTRODUCTION OF THE DRAWINGS

A specific embodiment of the invention will now be described in detail by way of example with reference to the accompanying drawings in which:

FIG. 1 is a perspective view of a cover enclosing an inflatable active support system mattress, the cover having a top sheet, side sheets, end sheets, an outer skirt and a base portion, FIG. 2 is a cross sectional view of the cover during joining of the side sheets and outer skirt to the top sheet, FIG. 3 shows a stage in the method of making a cover, and FIG. 4 is a sectional view of the cover in the final stages of manufacture.

DESCRIPTION OF THE PREFERRED EMBODIMENT

Figure 1:
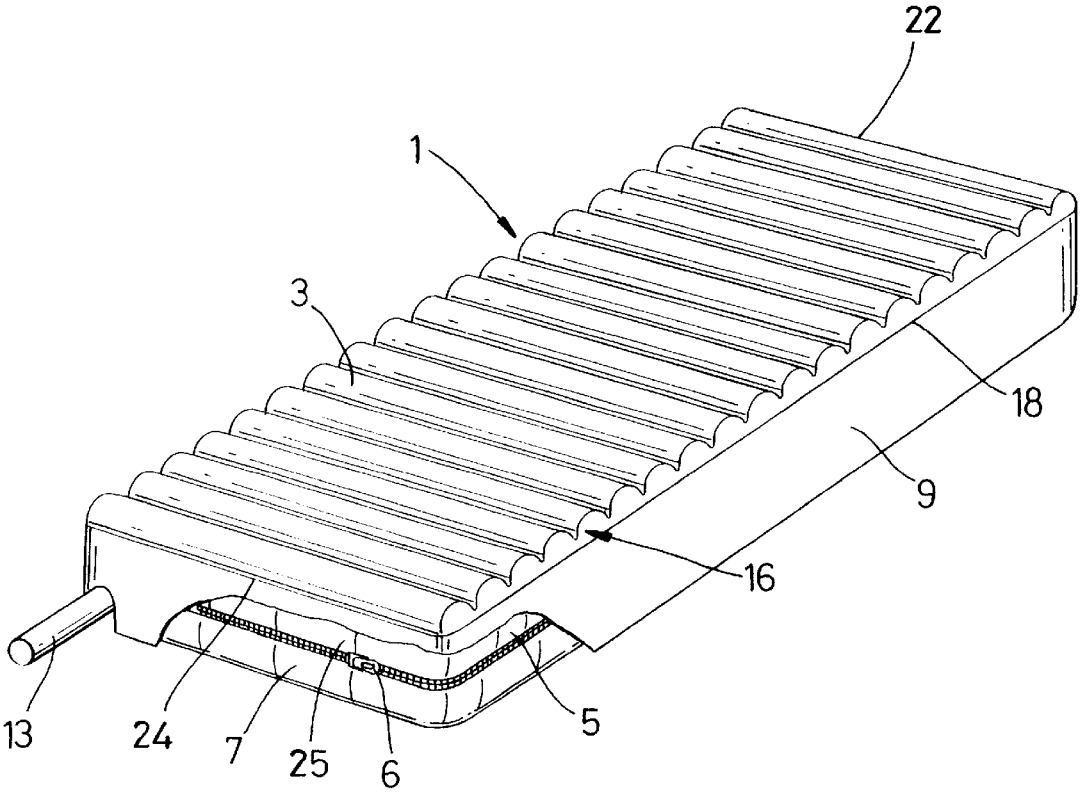

Referring to the figures, a cover 1 for an air inflatable mattress, such as an Airwave Plus™ sold by the assignees of the applicants and intended for the reduction of bed sores, is illustrated. An example of this type of mattress is illustrated in GB-A-1595417.

The mattress within the cover 1 has a plurality of groups of inflatable elongate tubular air cells which inflate and deflate in a sequential manner to provide support, and relief from pressure, to a patient. The air cells lie transversely between the elongate edges of the mattress. In this embodiment there are two layers of the air cell tubes. A sheath 13 is provided at a corner of the mattress which accommodates the pipelines for supply and removal of air to and from the air cells. As shown, the cover 1 conforms to the undulating top surface of the array of the air cells, whilst fitting closely to the sides of the mattress.

The cover 1 has components in the form of a top sheet 3, two side sheets 5, two end sheets 25 and 26, a base 7 and an optional outer skirt 9. In this embodiment the components 3, 5, 9, 25 and 26 are all rectangular in shape and of a size to closely fit the mattress 2. The base 7 is in the shape of an open box.

The top sheet 3 is a single elongate piece of stretchable material, of a width between its lines of attachment to the side sheets 5 substantially equal to the width of the mattress 2 and a length in its laid-flat state greater than the length of the mattress 2. In this embodiment the length of the top sheet in its laid-flat state is approximately 25% greater than the length of the mattress 2, this increase being approximately equal to the difference in length of the upper surface of the mattress 2 between the state where all cells are in a deflated state and the state of maximum inflation at any one point during the cycle.

In this embodiment, the two side sheets 5 and the two end sheets 25, 26 are formed from a single elongate piece of stretchable material, having a width approximately equal to half the depth of the mattress 2 and a length substantially equal to the circumference of the mattress. The side sheets 5 and end sheets 25, 26 are joined to the box-like base 7 which covers the lower half of the mattress 1 by a zip fastener 6. Alternatively, the assembly of side sheets 5 and end sheets 25, 26 may be formed of two or more pieces of stretchable material.

The outer skirt 9, as shown in FIG. 1, is an elongate piece of stretchable fabric, and extends almost over the entire depth and around the circumference of the mattress, thus reducing risk of fluid entry through the zip fastener 6 between the side sheets 5 and the base portion 7. Preferably the outer skirt has a weight of at least 50% of the mattress, and covers any joint in the side of the cover, e.g. the zip fastener.

The individual components 3, 5, 9, 25 and 26 are assembled to form an upper part 16 of the cover 1. The base portion 7 completes the assembly. The upper part 16 and the base portion 7 are separable, allowing easy cleaning and replacement, as well as easy assembly on the mattress.

In the complete cover 1 of the present embodiment the upper part 16 and the base portion 7 are joined by the zip fastener 6. One half of the zip fastener 6 is attached to the open edge of the side sheets 5 and end sheets 25, 26, the second half being attached to the circumference of the side sheets and end sheets of the base portion 7. The upper part 16 and the base sheet 7 can then be zipped together to form a complete cover 1. In this embodiment the zip fastener 6 is an open ended spiral type zip, designed to withstand high temperatures without distortion of its components.

Figure 5:
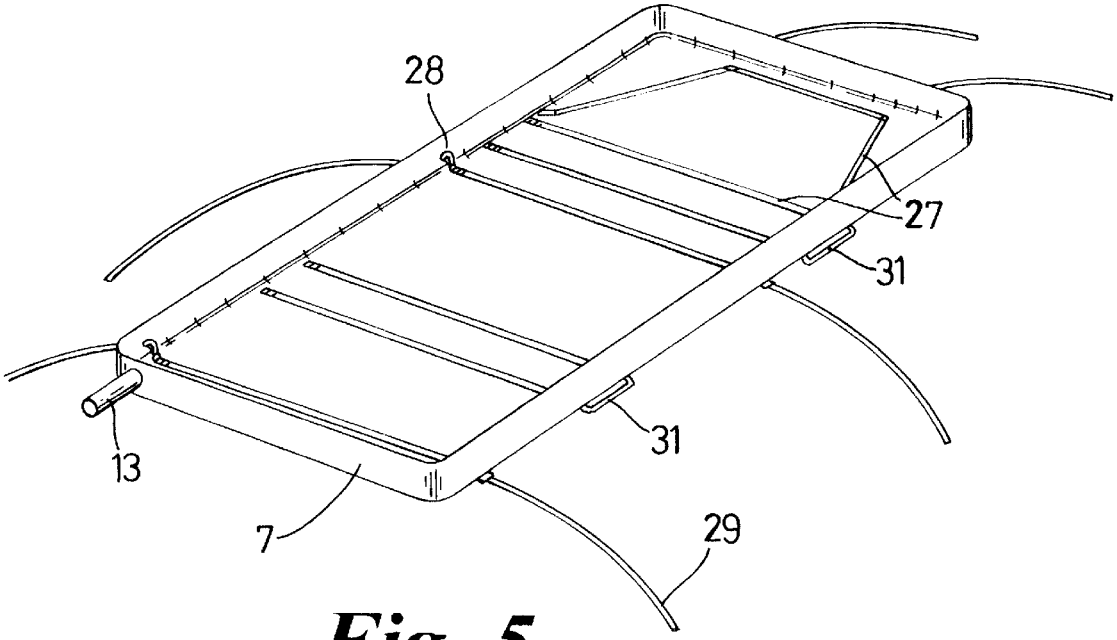
FIG. 5 shows the internal and external strap system and the handles of the base portion.
Figure 6:
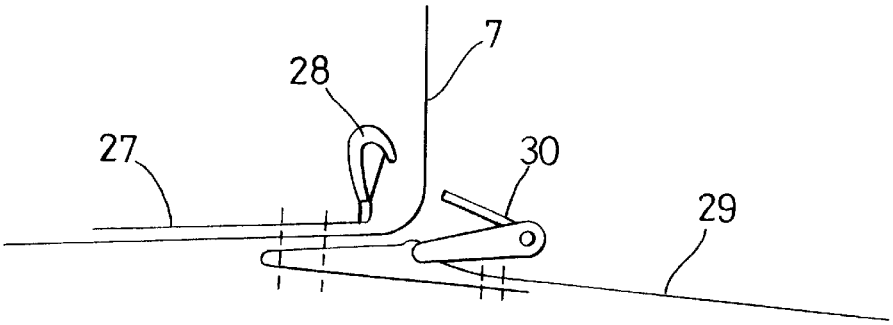
FIG. 6 is an enlarged view of internal/external strap attachment region.

The cover 1 also comprises an inner strap system 27, as shown in FIG. 5, for securing the mattress within the cover 1 and allowing any stress applied to the cover 1 to be taken by the mattress. The internal straps 27 are fixed at one end to the cover, and comprise a hook 28 at the other end which is fitted to the mattress 2. The internal straps 27 may extend in any direction within the base portion 7. The internal straps 27 are joined to external straps 29 by stitching through the base portion 7. The external straps 29 comprise a cam lock type buckle 30, in order to secure the external straps 29 to an external support. The external straps 29 are located at the head, foot and halfway along the cover 1.

In this embodiment, handles 31 are provided on the external surface of base portion 7. A pair of handles 31 are located on each side sheet of the base portion 7, as seen in FIG. 5. As described above, the handles may be integral with, or attached to the internal straps. The handles may be stitched to both the internal strap and the cover, or to the cover only.

The cover 1 is made of any suitable material, preferably being waterproof and capable of withstanding repeated washes and wear and tear. An example of such a material is a polyurethane-coated nylon material known as Dartex™ (Penn Nyla, Nottingham, England). This material is stretchable, waterproof and hydrophilic vapour-permeable and can withstand washing temperatures up to about 90° C. In the present embodiment, three types of Dartex™ are used in the individual components 3, 5, 7, 9, 25 and 26 of the cover 1. P072, a heavy weight single-sided double stretch material, is used for the top sheet 3, side sheets 5 and end sheets 25,26. P098, a lightweight double-sided and double stretch material with good memory retention properties is used for the outer skirt 9. This material has the ability to be held in an extensively stretched condition whilst being stitched or machined, but will return to its original length when relaxed. It has a coating on both sides, and in this embodiment, the heavier coating is outermost. P097, a heavyweight double-sided material with minimal stretch properties is used for the base portion 7.

Figure 2:
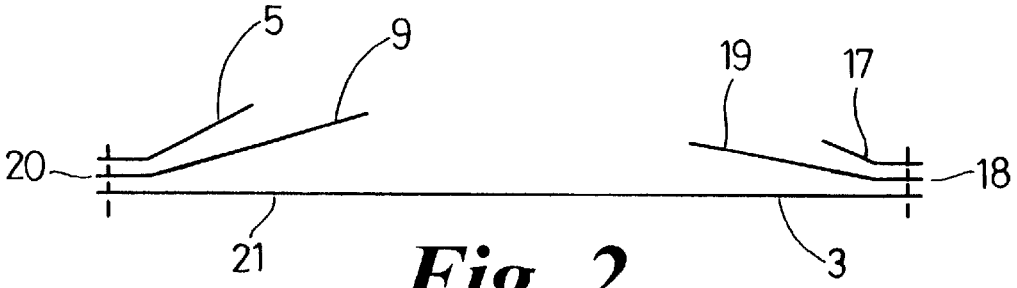
Figure 3:
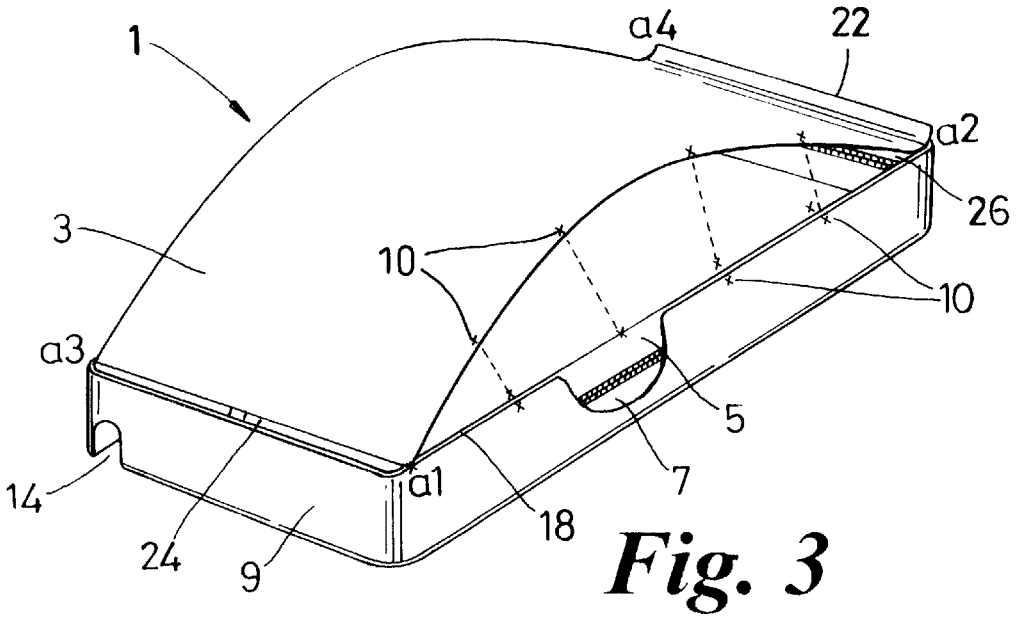
Figure 4:
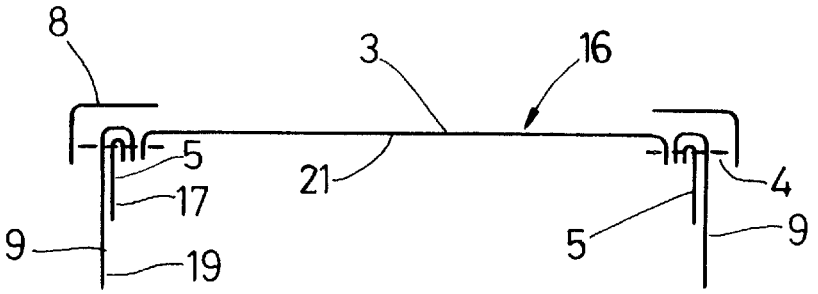

The method of making the cover 1 is illustrated in FIGS. 2 to 4. Firstly, a zip fastener is attached to the single sheet of fabric which forms the side sheets 5 and end sheets 25, 26, and this sheet is then made into a closed loop. The outer skirt 9 is also made into a closed loop, the bottom edge turned upwards, hemmed and tape sealed. The zip fastener and tape sealing in this case are of a material suitable for stretching during the following process. The single sheet forming the side sheets 5 and end sheets 25, 26, and the outer skirt 9 are placed against the outer surface of the top sheet 3, such that they lie parallel with their inner surfaces 17 and 19 respectively facing in the opposite direction to the inner surface 21 of the top sheet 3, as shown in FIG. 2.

With the three components aligned in the positions shown in FIG. 2, the side sheets 5 and outer skirt 9 are attached to the top sheet 3 at anchoring points marked a1, a2, a3, a4 in FIG. 3. Datum points, 10, are marked equidistant apart along the attachment lengths 18,20 to allow even stretch and distribution of the material along the complete length of each side. The distance between datum points is determined by the length of material an operator can handle during the joining process, and the maximum length that the three components 3, 5 and 9 can be stretched and joined with minimum movement or "creep" occurring between them.

Joining of the side sheets 5 and outer skirt 9 to the top sheet 3 is started at an attachment point, for example, "a1". The first pre-marked datum point 10 along the attachment length 18, along from "a1" is located on all three components. Said datum points 10 are held adjacent to each other. The material between said point "a1" and said first datum point is stretched such that the length of all three components between said points becomes equal. Thus, the side sheets 5 and outer skirt 9 are stretched by approximately 25% of their original length, and the top sheet 3 is stretched by 5%. Stretching of the top sheet 3 at this stage prevents puckering of the top sheet 3 during the process.

The top sheet 3, side sheets 5 and outer skirt 9 are held in the stretched state while they are joined by stitching from point "a1" to the first datum point 10. When this position is reached, the joined portion is allowed to relax from its stretched condition.

The process is then repeated from the point at which joining stopped to the next datum point along the whole attachment length 18.

The joining process is repeated in the same direction on the second attachment length edge 20. End sheets 25 and 26 are then stitched to the end attachment regions 22, 24 of the top sheet 3.

The side sheets 5, outer skirt 9, and end sheets 25, 26 are then everted as shown in FIG. 4 such that they lie perpendicular to the top sheet 3 when the cover 1 is fitted to the mattress 2. An outer joint 4 is formed by stitching through all components, as shown in FIG. 4. The outer joint 4 is then sealed with a heat sealing tape 8, this heat sealing tape 8 being a polyurethane heat sealing tape.

In an alternative embodiment, the zip fastener 6 is not stretchable, and is attached after the assembly of the components 3, 5, 9, 25, 26 as described above.

The base portion 7 is formed from a sheet of heavyweight, double-sided Dartex™ formed into a box-like structure. The seams are sealed by heat sealing tape, and the second half of the zip fastener 6 is attached to the open edge of the base portion 7, for attachment to the upper portion 16.

The type of stitching used in this embodiment is a machine stitch, with a pitch set to give approximately 12 stitches per inch.

It should be understood that a preferred embodiment of the present invention has been described above by way of example only and various alternative features or modifications from what has been described and illustrated can be made within the scope of the invention.

What is claimed is:

1. A method of making a cover for a support having a plurality of inflatable cells, said cover comprising a top sheet and side sheets to which the top sheet is attached along opposite edges, said side sheets comprising a stretchable material, wherein the method comprises:

(i) stretching the side sheets along their length, and (ii) joining the side sheets in the stretched condition to the top sheet when the top sheet is in a bloused condition selected from unstretched and stretched to a lesser extent than said side sheets so that when the side sheets are relaxed, they cause the top sheet to assume a length which is less than its laid flat length.

2. A method according to claim 1 including joining end sheets to the side and top sheets.

3. A method according to claim 1, wherein the top sheets and side sheets are joined by stitching.

4. A method according to claim 1 including applying tape and sealing it to the top and side sheets, so as to cover and seal over the attachment of the top and side sheets.

5. A method of making a cover for a support having a plurality of groups of tubular inflatable cells, said cover having a top sheet and side sheets to which the top sheet is attached at opposite edges along an attachment length, said side sheets comprising a stretchable material, wherein the method comprises the following steps:

(i) joining the side sheets to the edges of the top sheet extending in a direction perpendicular to the longitudinal direction of the inflatable cells, at one or more points spaced apart along the attachment length, and (ii) stretching the side sheets along their length and joining the side sheets to said edges of the top sheet between said points when said top sheet is in a bloused condition selected from unstretched and stretched to a lesser extent than said side sheets.

6. A method according to claim 5 including joining end sheets to the side and top sheets.

7. A method according to claim 5 wherein the top sheets and side sheets are joined by stitching.

8. An inflatable support having a plurality of air inflatable cells, which are arranged in an array and which in operation of the support are inflated and deflated in a sequential manner to provide support and pressure relief to a patient, said array of said cells having an undulating top surface, and a cover comprising a top sheet overlying said cells and having opposite side edges and opposite side sheets to which the top sheet is attached at opposite edges along an attachment length, said side sheets comprising a stretchable material, wherein the length of the top sheet attached to the side sheets at said attachment length is, in its laid flat state, greater than the length of said side sheets attached to the top sheet at said attachment length, whereby said top sheet conforms to said undulating top surfacing of said array of said cells when said top sheet is in its operative position on said cells while said side sheets lie flat against the sides of said array of said cells.

9. An inflatable support according to claim 8 wherein said cover has end sheets joining the side sheets and top sheet.

10. An inflatable support according to claim 8 wherein said cover comprises a base portion attached to said side sheets.

11. An inflatable support according to claim 10, wherein said base portion is joined to said side sheets by a zip fastener.

12. An inflatable support according to claim 8 wherein said cover comprises one or more internal straps for securing said support to the cover.

13. An inflatable support according to claim 12 wherein an end of one or more said internal straps is integral with or attached to an external strap, in order to secure the support and cover to an external member.

14. An inflatable support according to claim 8 wherein said cover further comprises an outer skirt extending around at least part of the perimeter of the cover, and overlying said side sheets.

15. An inflatable support according to claim 8 wherein said inflatable cells are inflatable tubular cells having their longitudinal direction extending transversely between said sides of said array, and said length of said top sheet of said cover, which is greater than said length of said side sheets, extends in the direction perpendicular to said longitudinal directions of said inflatable tubular cells.

16. An inflatable support having a plurality of air inflatable cells, and a cover comprising a top sheet overlying said cells and having opposite side edges and side sheets to which the top sheet is attached at opposite edges along an attachment length, said side sheets comprising a stretchable materal wherein the length of the top sheet attached to the side sheets at a said attachment length is, in its laid-flat state in its operative position on said cells extending in the direction perpendicular to the longitudinal direction of the inflatable tubular cells, greater than the length of the side sheets extending in the same direction attached to said top sheet at said attachment length.

* * * * *